US011905078B2

(12) United States Patent
Königseder et al.

(10) Patent No.: US 11,905,078 B2
(45) Date of Patent: Feb. 20, 2024

(54) TAMPER-EVIDENT FLIP-TOP CLOSURE

(71) Applicant: Aptar Freyung GmbH, Freyung (DE)

(72) Inventors: Bruno Königseder, Röhrnbach (DE); Daniel Frey, Grainet (DE); Andreas Rückert, Ringelai (DE)

(73) Assignee: Aptar Freyung GmbH, Freyung (DE)

( * ) Notice: Subject to any disclaimer, the term of this patent is extended or adjusted under 35 U.S.C. 154(b) by 320 days.

(21) Appl. No.: 17/618,224

(22) PCT Filed: Nov. 7, 2019

(86) PCT No.: PCT/EP2019/080510
§ 371 (c)(1),
(2) Date: Dec. 10, 2021

(87) PCT Pub. No.: WO2021/089149
PCT Pub. Date: May 14, 2021

(65) Prior Publication Data

US 2022/0258929 A1 Aug. 18, 2022

(51) Int. Cl.
*B65D 47/08* (2006.01)
*B65D 55/02* (2006.01)

(52) U.S. Cl.
CPC ..... *B65D 47/0809* (2013.01); *B65D 55/024* (2013.01); *B65D 2401/30* (2020.05)

(58) Field of Classification Search
CPC ..... B65D 47/0809; B65D 2401/00; B65D 47/0804; B65D 2401/30; B65D 55/024
See application file for complete search history.

(56) References Cited

U.S. PATENT DOCUMENTS

2002/0166836 A1 11/2002 Moretti
2016/0016706 A1 1/2016 Rognard et al.

FOREIGN PATENT DOCUMENTS

WO WO-2015049066 A1 * 4/2015 ..... B65D 47/0804

* cited by examiner

*Primary Examiner* — Anthony D Stashick
*Assistant Examiner* — Lauren Kmet
(74) *Attorney, Agent, or Firm* — Wood, Phillips, Katz, Clark & Mortimer

(57) ABSTRACT

The present invention relates to a closure for a container with a base element (100), a flip-top lid (200) attached to said base element (100) by a hinge (150) such that the flip-top lid (200) can be moved between an opened and a closed position, and with a tamper evident unit (400) for indicating whether the flip-top lid (200) had been opened at least once by a user or not. Said tamper evident unit (400) comprising a first tamper evident element (420) and a second tamper evident element (440), which are, when said closure is in its as-manufactured status or when said flip-top lid (200) has not been opened yet by the user, connected to each other by at least one frangible bridge (430). Said first tamper evident element (420) is attached to the base element (100) such that it is movable between a first position and a second position, wherein said first tamper evident element (420) is in its first position, when said closure is in its as-manufactured status or when said flip-top lid (200) had not been opened yet by the user, and said first tamper evident element (420) is in its second position, when said flip-top lid (200) had been opened at least once by the user.

18 Claims, 4 Drawing Sheets

TAMPER-EVIDENT FLIP-TOP CLOSURE

FIELD OF THE INVENTION

The present invention relates to the closure or a closure device for a container and to a system with a container and with such a closure or closure device.

BACKGROUND OF THE INVENTION

Such closures are typically used for dispensing products contained in a container to which said closure is attached.

The products to be dispensed are typically fluid products, like e.g. liquids or powdered or granular products, e.g. in the food or beverage area, but also in other applications, e.g. for cleaning substances, detergents or other products.

The present invention especially relates to a closure having a flip-top lid being attached to a base element by a hinge, while such a flip-top lid can be moved between an opened and closed position, while said flip-top lid is typically rotated around said hinge between its opened and its closed position.

Such closures are for example known from EP 2 121 466 B1 or from WO 2013/023742 A2.

It is an object of the present invention to provide an enhanced closure or closure device and an enhanced system with an enhanced tamper evident system for indicating whether the flip-top lid had been opened at least once by a user or whether it is still in its original, unopened status.

BRIEF SUMMARY OF THE INVENTION

This object is solved by a closure for a container according to claim 1 and a system with a container and such a closure according to claim 15. Claims 2 to 14 refer to specifically advantageous realizations of the closure according to claim 1. The present invention also relates to a method for manufacturing such a closure according to claim 16. Claims 17 and 18 relate to specifically advantageous realizations of such a method for manufacturing such a closure.

According to the present invention the closure for a container comprises a base element and a flip-top lid, which is, directly or indirectly, attached to said base element by means of a hinge.

This connection or attachment of the flip-top lid to the base element is realized such that the flip-top lid can be moved between an opened and a closed position.

Preferably the base element has a skirt with attachment means for attaching the closure to a container. The attachment means may comprise an inner or an outer thread for interaction with a corresponding thread at a container, especially a neck of a container. The closure can also be realized as a snap-on closure comprising a snap-on bead for attachment to a container, preferably a neck of a container. However, it is also possible that closure and container are an integrated or unitary element, and it is also possible that the closure is attachable to a container, preferably to a neck of a container, by other fastening means, for example by application of heat, gluing or other means.

According to the present invention the closure comprises a tamper evident unit with a first tamper evident element and a second tamper evident element. Said first tamper evident element and said second tamper evident element are, in its original status and after manufacturing ("as-manufactured status") and before use, or before a first opening by the user, connected to each other by at least one frangible bridge.

Said first tamper evident element is positioned or retained relative to the base element of the closure such that it is movable between a first position and a second position. According to the invention, said first tamper evident element is in its first position, when said closure is in its as-manufactured status and/or when said flip-top lid had not been opened yet by the user. Said first tamper evident element is in its second position, when said flip-top lid had been opened by the user at least once. Preferably said first position is an upper position and said second position is a lower position, while the upper part of the closure is the part where the flip-top lid is positioned and the lower part of the closure is the part where the base element is positioned. The movement from the first position into said second position is therefore preferably a movement in a direction moving away from the flip-top lid.

Said first and/or said second tamper evident element is/are preferably made from a material being completely non-transparent or opaque or having at least only a low transparency, especially for light in the visible range. Said first and/or second tamper evident element are, in a specifically preferred embodiment, color-coded.

According to the invention said flip-top lid is, at least in part, transparent or translucent and/or comprises at least one window or opening. Thereby at least part or parts of the tamper evident unit, comprising said first and said second tamper evident element, is visible for the user even when the flip-top lid is in its closed position. It is therefore possible for the user to recognize the position of the tamper evident unit or the first and/or the second tamper evident element within the closure or relative positions of each of the elements to each other or relative to other parts of the closure, especially relative to the base element. The flip-top lid is especially arranged such that the user can at least see a part or portion of the second tamper evident element, when said first tamper evident element is in its second position, even when the flip-top lid is in its closed position.

The user can especially easily recognize the positions or relative positions of these elements when said first and/or second tamper evident element are color-coded or otherwise optically distinguished from each other, as it is the case in a preferred embodiment.

Preferably at least part of the flip-top lid is realized in or with a transparent or translucent material, more preferably the complete flip-top lid is made from a transparent or translucent material, and in a very preferred embodiment both the base element and the flip-top lid are transparent or translucent. The level of transparency or translucency as well as the positions of the one or multiple transparent or translucent portions (if not the complete flip-top lid or even if the complete flip-top lid and the base element are made from a transparent or translucent material) or the position of the at least one opening or window can be adapted.

According to the present invention said base element comprises at least one spring element being arranged such that it applies a force FS onto said first tamper evident element into a direction towards the second position of said first tamper evident element, wherein said force FS is smaller than the minimum force FD being necessary to destroy the at least one frangible bridge.

Furthermore said flip-top lid comprises a first inner extension wall with first engagement means and said second tamper evident element comprises second engagement means, wherein said first and said second engagement means being arranged such that they engage with each other when said closure is in its as-manufactured status.

According to the invention said first engagement means of said first inner extension wall of said flip-top lid and said second engagement means of said second tamper evident element are arranged such that a minimum force FE being necessary to disengage the first and the second engagement means is larger than said force FD being necessary to destroy the at least one frangible bridge.

Such a closure according to the present invention has numerous advantages, and it especially provides an enhanced tamper evident indication to the user.

One advantage being especially that the complete tamper evident unit can be arranged fully within the inner parts of the closure, so that it is not possible to manipulate it from the outside without opening the flip-top lid, which would then automatically lead to a destruction of the frangible bridge, thereby indicating that the closure has been tempered with and that said flip-top lid had been opened at least once.

Another advantage is that the tamper evident unit will be automatically destroyed by opening of the flip-top lid, therefore no other activity by the user is necessary to open the flip-top lid.

After the tamper evident unit has been destroyed, in other words after the frangible bridge or bridges between the first tamper evident element and the second tamper evident element has or have been destroyed, both the first and the second tamper evident element are still attached and fastened to the closure, although being separated from each other. The first tamper evident element will be still fixed to the base element, while the second tamper evident element is still fixed to the flip-top lid. It is thereby secured that no part of the closure or the tamper evident unit will be detached from the closure, which avoids multiple separate parts, being important for recycling and for avoiding small separate garbage parts after the closure has been used.

The provision of the spring, together with the other features of the closure according to the present invention, especially has the advantage that it applies a force onto said first tamper evident element, with the effect that after a destruction of the frangible bridge the first tamper evident element is pushed or forced into its second position, indicating that the flip-top lid had been opened at least once. One specific advantage is that the movement of the first tamper evident element into its second position is independent of gravity. Even if therefore the closure or the container with such a closure is in an upside down position, e.g. held in such a position by a user, the first tamper evident element will move into its second position. This is of specific advantage especially when such a closure is used for container systems which stand upside down, e.g. on its closure or are held in such a position, as frequently used for example in of the beverage area, e.g. for honey containers or ketchup containers. The tamper evident unit will therefore always indicate the status correctly, as independent of the position of the closure with respect to the gravity direction, the first tamper evident element will be pushed into its second position.

With a closure according to the present invention it is especially avoided that any malfunction can be created depending on potentially different handling of the closure by different users, as the only activity the user can perform and has to perform is opening of the flip-top lid, while it is not possible for the user to otherwise manipulate or influence or activate the tamper evident unit.

According to a preferred embodiment said first tamper evident element and said second tamper evident element are ringlike elements, in a specifically preferred embodiment the first and second tamper evident elements are circular or essentially circular elements. These elements are easy to manufacture, furthermore it is preferred that such closures have an essentially cylindrical outer form, in which case the first and second tamper evident element or the tamper evident unit can be easily inserted into the device, enabling reliable and efficient manufacturing, thereby saving manufacturing costs.

Preferably said second tamper evident element is smaller or has smaller diameter or smaller outer extensions than said first tamper evident element. This has the advantage that the second tamper evident element can be essentially positioned within said first tamper evident element, when being in its as-manufactured status, i.e. when the frangible bridge has not been destroyed. This provides the possibility that the view onto the second tamper evident element from the outside could be hindered or even completely blocked, so that the second tamper evident element cannot or can hardly be seen by a user from the outside. Only after destruction of the frangible bridge, the second tamper evident element can be seen for the first time by the user, clearly indicating to the user that the closure had been tempered with, in other words that the flip-top lid has been opened at least once.

A further specific advantage is achieved when giving the first tamper evident element and the second tamper evident element different colors, which e.g. can be realized by manufacturing the tamper evident unit by bi-injection molding. Preferably the second tamper evident element, which becomes more or only visible after destruction of the frangible bridge, can be realized e.g. in red color, as the color red typically indicates to a user a notification status, in this case providing an information that the flip-top lid had already been opened. However, of course also other colors, e.g. blue, can be selected. The first tamper evident element could be for example realized in green color or in a neutral or gray color. With such an arrangement, the specific color of the second tamper evident element is only visible to a user for the first time after the frangible bridge has been destroyed and after the first tamper evident element has been moved out of its first position into its second position.

According to a further preferred embodiment said first tamper evident element and said second tamper evident element are concentric or essentially concentric to each other, wherein preferably said first tamper evident element has a height being larger than the height of said second tamper evident element. Such a realization has the advantage that the second tamper evident element can more easily or more effectively be positioned and arranged such that it is hardly visible or not visible from the outside as long as the frangible bridge has not been destroyed or as long as the first tamper evident element is still in its first position.

In order to even further enhance the above-mentioned advantages, it is preferred that said second tamper evident element is arranged within said first tamper evident element such that the height of said second tamper evident element fully overlaps with a height of said first tamper evident element. Thereby it can be realized that the second tamper evident element cannot be seen by a user when viewed from a radial outward direction when said at least one frangible bridge is undestroyed or when said first tamper evident element is still in its first position.

According to a preferred embodiment said first tamper evident element comprises an outwardly extending protrusion which is arranged such that said at least one spring element of said base element exerts a force onto said protrusion of said first tamper evident element into the direction of said second position of said first tamper evident element. Such a realization has the advantage that a force applied by said spring can be easily, reliably and effectively transferred to said first tamper evident element.

According to a further preferred embodiment, said tamper evident unit comprises multiple frangible bridges connecting said first tamper evident element and said second tamper evident element. Further preferably said multiple frangible bridges are arranged around an outer circumference of said second tamper evident element, further preferably in essentially equal angular distances from each other. The provision of multiple frangible bridges has the advantage that the connection between said first tamper evident element and said second tamper evident element, in its as-manufactured status, is secured at multiple positions, thereby securing more exact positioning of the second tamper evident element relative to the first tamper evident element. Furthermore, the forces applied to the first and the second tamper evident element when opening the flip-top lid are more equally distributed, thereby enhancing secure functioning of the tamper evident unit.

In another embodiment it would be also possible to provide only one frangible bridge, which however may preferably extend essentially over the complete circumference of the second tamper evident element and between the first and the second tamper evident element. Such a continuous frangible bridge could be for example realized by a thin or breakable material connecting said first and said second tamper evident element.

According to a further preferred embodiment the closure comprises a spout being an element separate from said base element, preferably also manufactured separately, while said spout is inserted through an opening on an upper side of said base element and attached to said base element in a fixed position. Such a realization has the advantage that the spout can be manufactured separately, also e.g. by injection molding, which simplifies the manufacturing method and which also provides possibility to select a different material or a different color for the spout. Furthermore manufacturing or assembling of all parts, including the tamper evident unit, which is also preferably a unit being separate from the base and the flip-top lid on the one hand and the spout on the other hand, can be realized in a very effective, especially cost-effective way.

Preferably, said spout comprises an outwardly extending protrusion and said base comprises at least one abutment portion, wherein said protrusion and said at least one abutment portion are arranged such that they are positioned with a distance from each other, when being in its as-manufactured status or in its final position after manufacturing and assembling. Thereby a space is defined within the closure in which at least part of said at least one spring element and at least part of said outwardly extending protrusion of said first tamper evident element can be positioned. This space therefore ensures a reliable functioning of the tamper evident unit, and as this space is provided at the inside of the closure, it is not possible to influence this functioning from the outside by a user.

According to a further specifically advantageous realization said closure is arranged such that said first tamper evident element abuts against said spout, preferably against said outwardly extending protrusion of said spout, when said first tamper evident element is in its second position. Thereby a reliable and clearly defined second position is realized.

Preferably said at least one spring is arranged such that it exerts a force FF onto said first tamper evident element, preferably onto said outwardly extending protrusion of said first tamper evident element, when said first tamper evident element is in its second position. Thereby the first tamper evident element can be securely kept in its second position after a first opening of the flip-top lid by the user. The first tamper evident element will therefore not move back into its first position or even only partly into the direction of its first position, even if the closure or the container with the closure is moved, e.g. into an upside down position. A further specific advantage is that the first tamper evident element is in a fixed position and pressed against another element of the closure, so that it cannot be moved easily, thereby avoiding a rattling or other noises, which may otherwise happen in devices, where a detached part of the tamper evident unit is e.g. held in a defined space or pocket, in which, however, the detached part can still move and hit against other parts of the closure when the closure or the container with the closure is moved by the user.

In a further preferred embodiment said first inner extension wall has an essentially cylindrical form, extending from the top wall or a top region of said flip-top lid, wherein said spout and said first inner extension wall are arranged such that said spout is inserted into said first inner extension wall of said flip-top lid, when said flip-top lid is in its closed position. This realization has the advantage that it secures a proper and exact positioning of the flip-top lid relative to the spout and the base element. Furthermore it provides a sealing effect around the spout, which secures that the area of the spout, which also has a dispensing opening into the interior of the container to which the closure will be attached, is kept clean, both from dust or potentially from insects.

Further preferably said flip-top lid comprises a second inner extension wall, preferably having an essentially cylindrical form, wherein said second inner extension wall extends from a top part or top wall of said flip-top lid, wherein said spout and said second inner extension wall are arranged such that said second inner extension wall is inserted into a dispensing opening of said spout, when said flip-top lid is in its closed position. Thereby an additional sealing function is realized, both preventing dust and insects from entering into the dispensing opening and also preventing an exit of fluid material out of the dispensing opening and potentially into the interior of the flip-top lid.

The amount of the forces FS, FD, FE, and FF do depend on the specific design of the closure according to the present invention, especially its dimensions. The force FF is preferably selected such that it is larger than a force exerted onto said first tamper evident element by gravity, when said closure is in its upside down position. In order to securely avoid the movement of said first tamper evident element out of its second position, even if the closure is in its upside down position and/or when said closure or a container with such a closure is moved or agitated by a user, the force FF is selected to be even higher, for example at least 2 to 5 times larger than the above-mentioned gravitational force exerted onto said first tamper evident element or, in other words, exerted by said first tamper evident element due to its weight onto the at least one spring element.

The present invention also relates to a system with a container with a closure as described above, wherein said closure is attachable or attached to the container or wherein said closure is integrally formed with the container. If the closure is attachable or attached to the container, both said closure and said container comprises fastening means, which can interact with each other. In cases where the closure is integrally formed with the container, it is possible that the system is manufactured at least partly as a unitary system, e.g. the base element or part of the base element could be integrally formed with a part of the container. It is also possible to create such a system by fastening the closure and the container together by various attachment systems, for example by welding or gluing.

The present invention also relates to a method for manufacturing a closure or a system as described above. In a method for manufacturing a closure according to the present invention said base element and said flip-top lid are manufactured by injection molding, wherein said base element and said flip-top lid are injection molded in an open status, i.e. with said flip-top lid being in its opened position.

This has the advantage that the injection molding can be more easily realized and therefore most cost-effectively. Furthermore the base element and said flip-top lid can be arranged and designed such that any openings between said base element and said flip-top lid, when said flip-top lid is in its closed position, can be minimized or essentially avoided, thereby providing a closure avoiding the entrance of dust into the interior of the closure or avoiding the entry of insects into the interior of the closure, either completely or at least very effectively.

According to a preferred realization of the manufacturing method said spout is manufactured separately from said base element and said flip-top lid, wherein after injection molding of said base element and said flip-top lid in its open status, the flip-top lid is first brought into its closed position, wherein thereafter the tamper evident unit and said spout are inserted into said base element, while said flip-top lid is in its closed position.

Preferably said tamper evident unit is positioned onto said spout, while only thereafter said spout, together with said tamper evident unit, is inserted into said base element, while said flip-top lid is in its closed position. However, in another embodiment, it is also possible to first introduce the tamper evident unit into said base element and to then introduce the spout separately.

This order of manufacturing steps has the advantage that the manufacturing can be done easily and effectively, furthermore this order of manufacturing steps has the advantage that all elements are treated with care and that no damages may occur to any of the elements, as it may be the case when said flip-top lid would be brought into its closed position only after the spout and/or said tamper evident unit has been inserted into the base element, as the flip-top lid is moved from its opened position to its closed position on a circular path, contrary to the spout, which can be and is preferably introduced into the base element on a linear path.

BRIEF DESCRIPTION OF THE DRAWINGS

These and other advantages of the closure and the system according to the present invention will become even more apparent in view of the following figures showing a preferred embodiment of a closure according to the present invention.

DETAILED DESCRIPTION OF THE PREFERRED EMBODIMENTS

Figure 1:
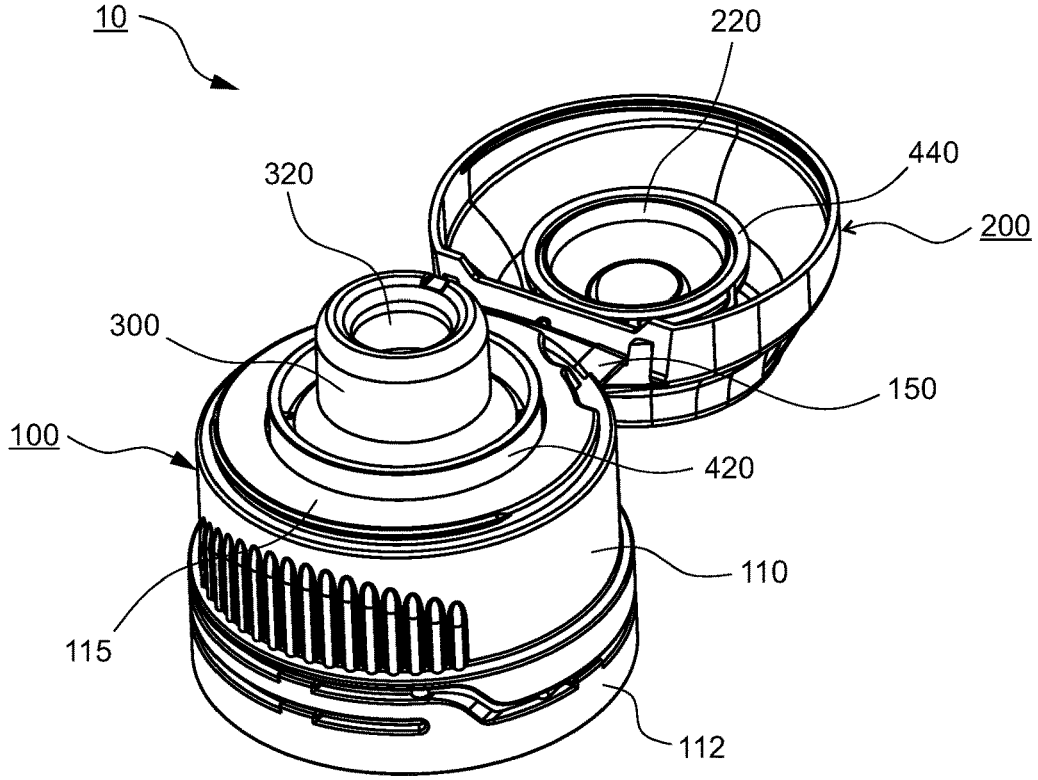
FIG. 1 shows a perspective view of an embodiment of the closure according to the present invention after a first opening by a user and with the flip-top lid being in its opened position.

FIG. 1 shows a perspective view of an embodiment of a closure 10 according to the present invention. The closure 10 comprises a base element 100 and a flip-top lid 200, being attached to said base element 100 by a hinge 150, wherein said flip-top lid 200 is in its opened position.

The base element 100 comprises an essentially cylindrically formed skirt 110 and an upper wall 115, which has a circular opening through which a spout 300 has been inserted. The spout 300 comprises a dispensing opening 320.

Around the spout 300 a first tamper evident element 420 of a tamper evident unit 400 is visible, wherein a second tamper evident element 440 of the tamper evident unit 400 is attached to the first inner extension wall 220, which has an essentially cylindrical form and which extends from a top wall or top part of the flip-top lid 200.

The closure 10 is shown after a first opening of the flip-top lid by a user, so that the frangible bridges, which had connected the first tamper evident element 420 with the second tamper evident element 440 in its as-manufactured status, being destroyed, so that the first and the second tamper evident elements 420 and 440 are separated. With respect to the functioning of the tamper evident unit 400 it is especially referred to hereinafter with respect to FIG. 4 to FIG. 6.

Figure 2:
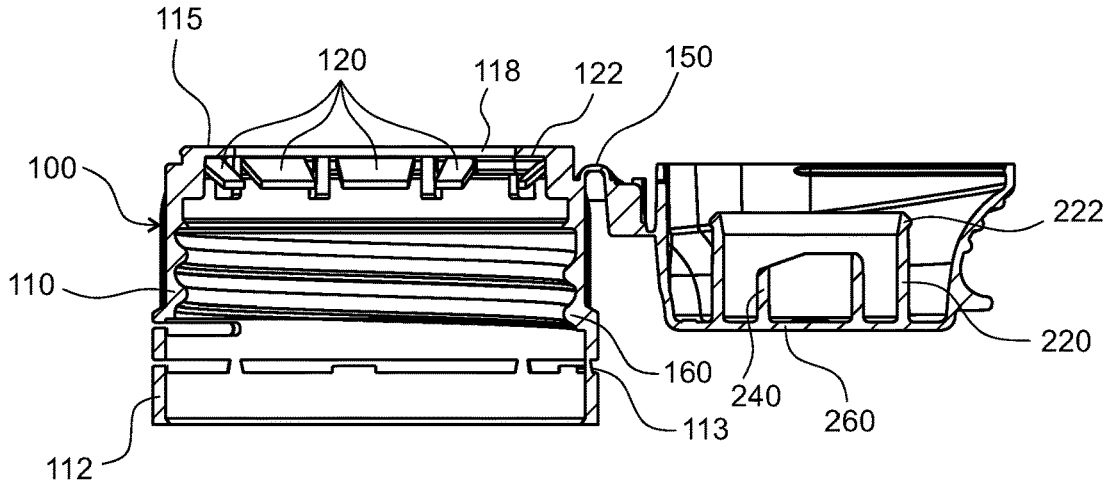
FIG. 2 shows an a cross-sectional view of embodiment of the closure according to the present invention during the manufacturing process, with a base element and a flip-top lid having been manufactured by injection molding in an opened position, however still without a tamper evident unit and without a spout.

FIG. 2 shows a cross-sectional view through part of the closure according to the present invention, however still without a spout and without a tamper evident unit. FIG. 2 shows the base element 100 and the flip-top lid 200, with the flip-top lid 200 in its opened position, as this embodiment has been manufactured by injection molding in an open status.

As can be well seen in FIG. 2 the base element 100 comprises the skirt 110 and an upper wall 115, with the skirt 110 being essentially cylindrical, whereas the upper wall 115 has essentially the form of a plane with an inner circular opening 118, through which a spout can be inserted, as will be shown in the following figures.

The base element 100 comprises fastening means 160, which are in this embodiment realized by an internal thread, which can cooperate with a corresponding external thread of the neck of a container to which the closure can be attached.

Furthermore the base element 100 also comprises, at a lower end part of the skirt 110, a tamper evident element 112, which indicates whether the closure has been detached from the neck of a container, in which is attached to the skirt 110 of the base element 100 by frangible bridges 113. This tamper evident element 112 is completely independent of the above-mentioned tamper evident unit 400.

As can be also well seen in FIG. 2 the base element 100 comprises spring elements 120, which extend, in FIG. 2 in a downward direction, from said upper wall 115. The spring elements 120 are shown in its release position, with respect to the functioning it is especially referred to FIGS. 4 to 6 and the corresponding description.

The base element 100 also comprises the flip-top lid 200, which has an upper wall or top wall 260. The flip-top lid 200 also comprises a first inner extension wall 220 with first engagement means 222, wherein the first inner extension wall 220 extends from said upper wall or top wall 260 and has an essentially cylindrical form. The first engagement means 222 are provided for an engagement with corresponding engagement means of the second tamper evident element 440, as will be explained hereinafter especially with respect to FIG. 4.

The flip-top lid 200 also comprises a second inner extension wall 240 also extending from said upper wall or top wall 260, which also has an essentially cylindrical form. As can be well seen in FIG. 2, the second inner extension wall 240 is positioned within the space defined by the first inner extension wall 220, the cylindrical form of the second inner extension wall 240 therefore has a smaller diameter and a smaller length or height compared with the cylindrical form of the first inner extension wall 220.

Figure 3:
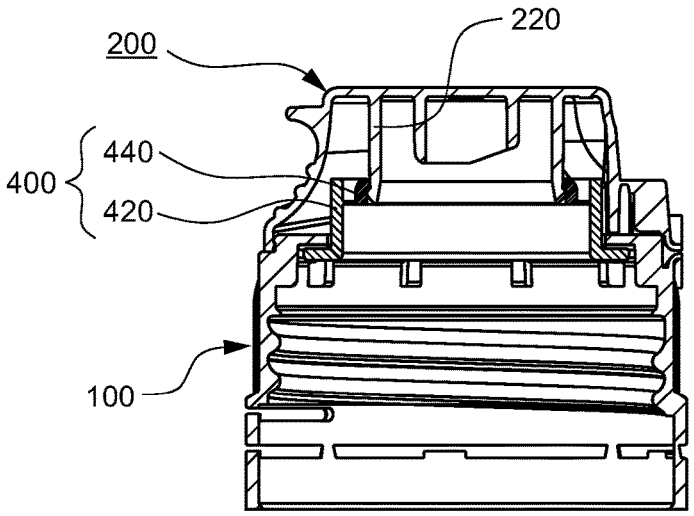
FIG. 3 shows an embodiment of the closure according to the present invention during the manufacturing process, with the tamper evident unit already inserted but with the spout not yet inserted.

FIG. 3 shows the closure as shown in FIG. 2, however with the tamper evident unit 400 already inserted but with the spout 300 not yet inserted. Due to the fact that the tamper evident unit 400 has already been inserted and brought into its correct position, with the first tamper evident element 420 in its first position, the spring elements 120 are already compressed, which can be well seen especially in FIG. 4 and the enlargement.

Figure 4:
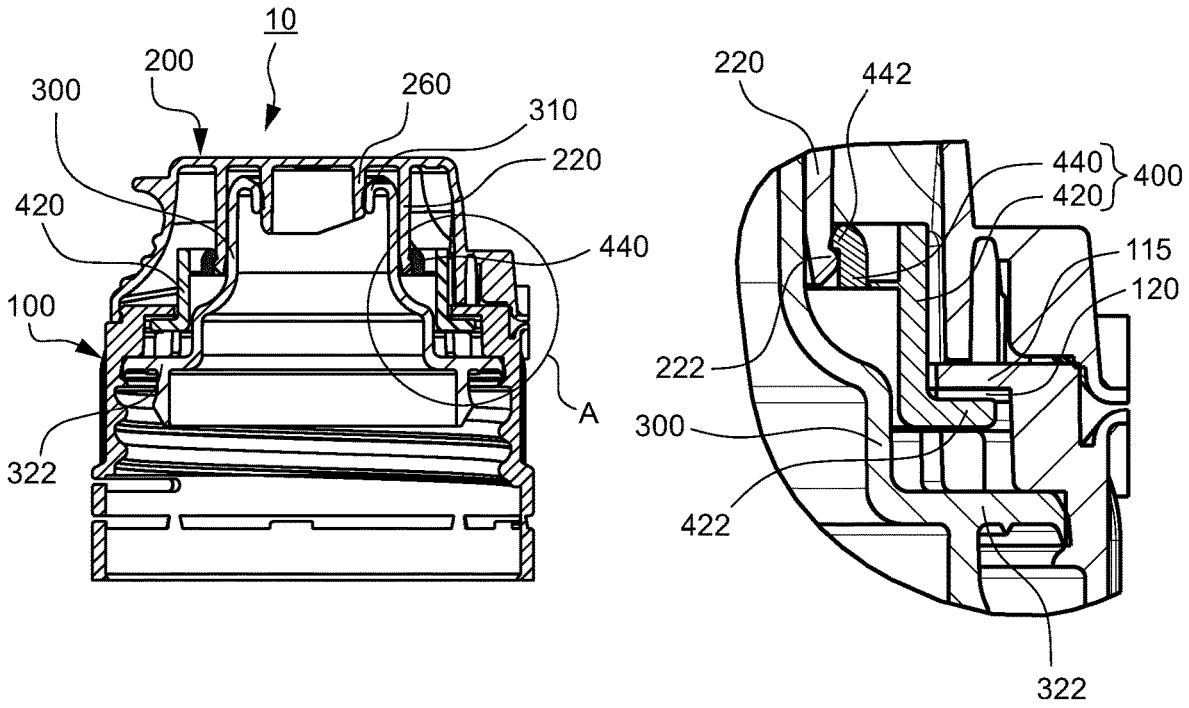
FIG. 4 shows a cross-sectional view of the closure as shown in FIG. 1, however in its as manufactured status, with the flip-top lid being in its closed position and before the flip-top lid has been opened by a user for the first time, together with a part of the closure being shown in an enlarged view.

The second tamper evident element 440 has been brought into engagement with said first inner extension wall 220, while both the second tamper evident element 440 and the first inner extension wall 220 comprise corresponding engagement means, which is also best shown in FIG. 4, so that is referred to the following explanation. The second tamper evident element 440 has thereby been fixed or attached to the first inner extension wall 220 and thereby to the flip-top lid 200.

As the first engagement means and said second engagement means are arranged such that the minimum force FE being necessary to disengage the first engagement means and said second engagement means from each other is larger than the force FD to destroy the frangible bridges between the first and the second tamper evident element, the second tamper evident element 440 will keep its position relative to the flip-top lid 200 or relative to the first inner extension wall 220 of the flip-top lid 200, independent of the position of the flip-top lid 200 in its closed or in its opened position.

FIG. 4 shows the closure to in its as-manufactured status, with the tamper evident unit 400 and the spout 300 being inserted and with the flip-top lid 200 being in its closed position, together with an enlargement of the section A.

Figure 7:
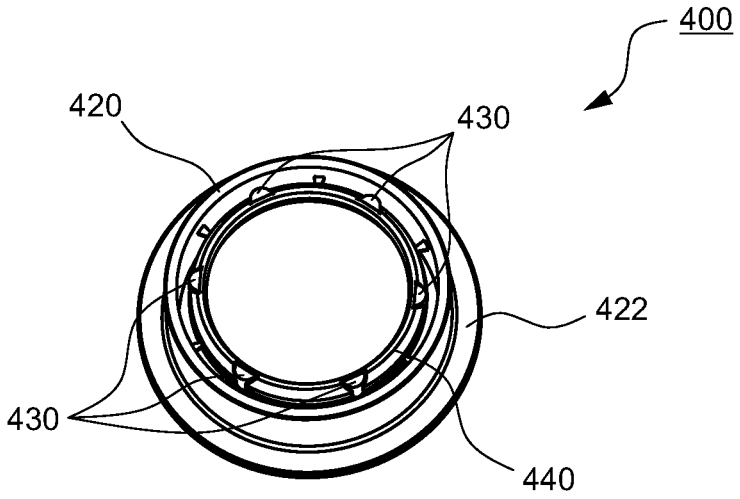
FIG. 7 shows a perspective view of an embodiment of the tamper evident unit as used in the embodiment of the closure according to the invention as shown in the earlier figures.

As can be well seen in FIG. 4, especially in the enlargement, the tamper evident unit 400 comprises the first tamper evident element 420 and the second tamper evident element 440, being connected by frangible bridges (in this embodiment all together 6 frangible bridges, which are positioned between said first tamper evident element 420 and the second tamper evident element 440 in equal angular distances, in this case of 60°, are provided, as can be well seen in FIG. 7).

In this as-manufactured status of the closure to the first tamper evident element 420 is in its first position, with respect to the orientation shown in FIG. 3 in its upper position. The spring elements 120 are compressed, between an outwardly extending, and in this embodiment ringlike, protrusion 422 of said first tamper evident element and an upper wall 115 of the base element too.

The second tamper evident element 440 comprises second engagement means 442, which in this embodiment are formed as an essentially ringlike protrusion on the radial inward side of the second tamper evident element 440. The flip-top lid 200 comprises the first inner extension wall 220 with corresponding first engagement means 222, which in this embodiment are formed as an essentially ringlike protrusion on the radial outward side of the first inner extension wall 220.

As can be best seen in the enlargement of FIG. 4, the first engagement means 222 and the second engagement means 442 are in engagement with each other, so that the second tamper evident element 440 is attached to said first inner extension wall 220.

The spring elements 120, as being compressed, apply or exert a force FS onto said first tamper evident element 420, more exactly on said protrusion 422 of said first tamper evident element 420. However, said force FS is smaller than the minimum force FD being necessary to destroy the frangible bridges (430, see especially FIG. 7), and as said force FS is not sufficient enough to destroy the frangible bridges, the tamper evident unit 400 is maintained in its original position and in undestroyed condition, so that the first tamper evident member 420 is hold and maintained in its first position.

As can be also well seen in FIG. 4, the second tamper evident element 440 is fully kept within the boundaries of the first tamper evident element 420, so that it is not or hardly visible when viewed from the outside in a radially inward direction. In other words, a user looking, in a radially inward direction, onto the closure can only see the first tamper evident element 420, not however the second tamper evident element 440, as being covered or at least mainly covered from view by the first tamper evident element 420.

In this specific embodiment the first tamper evident element 420 is at least partly made from a green and non-transparent material or with a very low transparency for light in a visible range, whereas the second tamper evident element 440 is fully or partly made from a red material. This can be easily realized by means of bi-injection molding. a user looking onto the closure with the first tamper evident element 420 being in its first position can therefore only see the green colored first tamper evident element 420, not however the red colored second tamper evident element 440. This is an indication to the user that the closure has not yet been tempered with, in other words an indication to the user that the flip-top lid has not yet been opened.

Of course it is possible to use also different coloring or other means for differentiating the optical appearance of the first tamper evident element 420 and the second tamper evident element 440.

As can be also well seen in FIG. 4, the first inner extension wall 220, extending from the upper or top wall 260 of the flip-top lid 200, encloses the outer wall of the spout 300, thereby leading both to the securing of an exact positioning of the flip-top lid 200 relative to the base element 100 and to a sealing effect between the first inner extension wall 220 and the spout 300.

Furthermore, the second inner extension wall 240 extends into the dispensing opening 320 of the spout 300, thereby sealing said dispensing opening 320. The spout 300 is provided with a flexible inner lip 310, which enhances this sealing effect.

Figure 5:
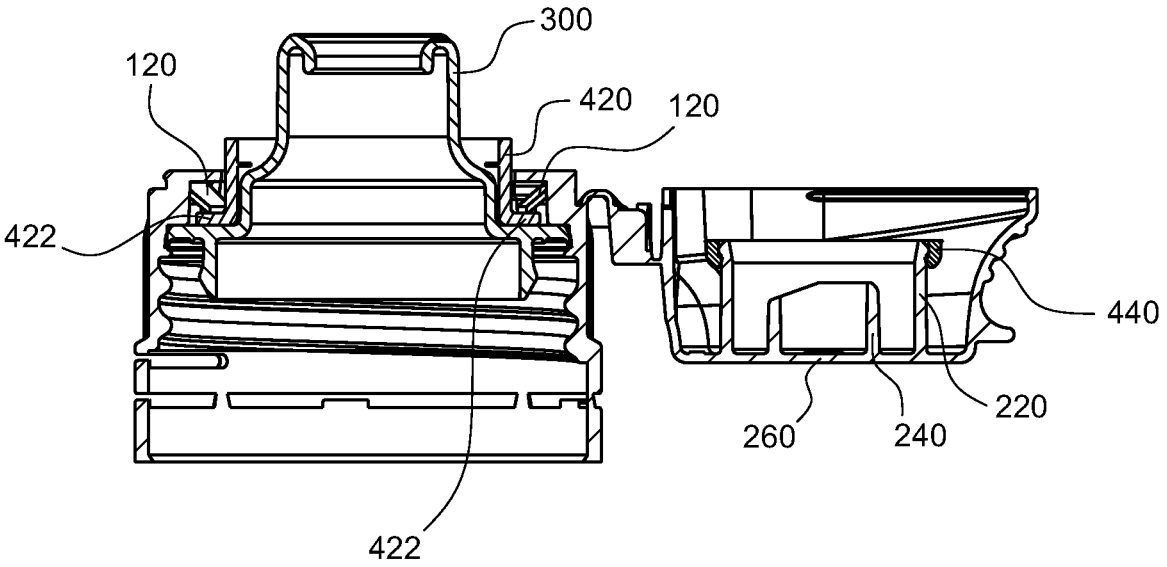
FIG. 5 shows the closure as shown in FIG. 4, with the flip-top lid being in its opened position.

FIG. 5 shows the closure 10 as shown in FIG. 4, however after a first opening, therefore with the flip-top lid 200 in its opened position. The opening of the flip-top lid 200 by a user required the force being higher than the minimum force FD, in order to destroy the frangible bridges between the first tamper evident element 420 and the second tamper evident element 440. Furthermore, as the minimum force FE being necessary to disengage the first engagement means 222 and the second engagement means 442 is larger than said force FD being necessary to destroy the frangible bridges, the first engagement means 222 and the second engagement means 442 are kept in engagement. As a result, the second tamper evident element 440 is still in engagement with the first inner extension wall 220, but separated from the first tamper evident element 420.

As the spring elements 120 apply a force FS onto said first tamper evident element 420, in this embodiment onto the protrusion 422 of said first tamper evident element 420, and as the first tamper evident element 420 is not attached anymore to the second tamper evident element 440 via the frangible bridges, the first tamper evident element 420 will be pushed into its second position (with respect to the orientation shown in FIG. 5 into the lower position) by the force of the spring elements 120.

The spring elements 120 are not in its fully released position, but still apply a remaining force FF onto said protrusion 422 of said first tamper evident element 420, thereby keeping and holding the first tamper evident element 420 securely in its second position, thereby securing a clear indication of the tamper evident unit to a user on the one hand, secondly securing that no rattling or other noise can be created, which otherwise may happen in case the first tamper evident element would be allowed to only slightly move out of its second position, possibly even hardly visibly, but than moving back again into its second position, while such a repeated abutment may cause disturbing noise during use or moving of the container with the closure by a user.

Figure 6:
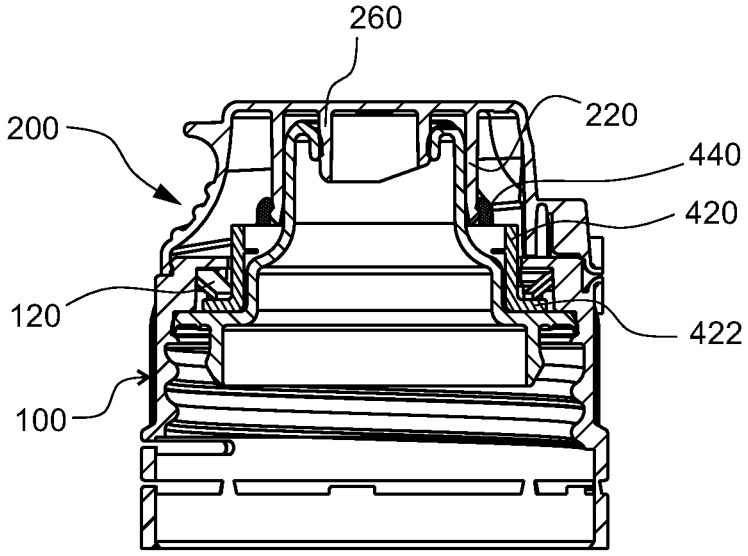
FIG. 6 shows the closure as shown in FIGS. 4 and 5, with the flip-top lid again being in its closed position, however after having been opened by a user at least once.

FIG. 6 shows the embodiment of the closure 10 as shown in FIG. 5, however with the flip-top lid 200 being again in its closed position. As can be well seen when comparing FIG. 5 with FIG. 6, the position of the first tamper evident element 420 relative to the base element and the position of the second tamper evident element 440 with respect to the flip-top lid 200 are not changed, with the first tamper evident element 420 being in its second position.

As can be well seen in FIG. 6, the second tamper evident element 440 is now positioned above the first tamper evident element 420, as the first tamper evident element 420 has moved from its first position to its second position (with respect to the orientation shown in FIG. 6 from an upper to a lower position).

The user looking from the outside onto the closure, especially from a radial outward side, now easily sees the second tamper evident element 440, as not being covered from view any more by the first tamper evident element 420, as it is the case with the first tamper evident element 420 being in its first position, as shown in FIG. 4. Therefore the user can see the second tamper evident element 440, which thereby clearly indicates the change in the system, thereby informing the user that the flip-top lid 200 has been opened once.

As mentioned above, if for example the first tamper evident element 420 is colored in red, the user would, for the first time, see the red element, namely the red first tamper evident element 420, thereby, in a very obvious view, indicating the different status of the closure, namely a closure which has been opened at least once.

As mentioned above, the spring elements 120, still asserting the force onto said protrusion 422 of said first tamper evident element 420, secure that the first tamper evident element 420 will be securely hold in its second position, so that the first tamper evident element 420 will be always visible, also in case the closure or the system with a container and closure will be held upside down. This specific arrangement makes a closure according to the present invention as a preferred choice also for containers with closures which are stored upside down, e.g. which have a stand surface on the closure side. In this case the top surface 260 of the flip-top lid 200 serve as such a stand surface for the closure and the system with a container.

FIG. 7 shows a perspective view of the tamper evident unit 400 as used in the embodiments described above. The tamper evident unit 400 comprises the first tamper evident element 420 and second tamper evident element 440, while the first tamper evident element 420 and the second tamper evident element 440 are connected by frangible bridges 430. In this specific embodiment there are six frangible bridges 430 between the first and the second tamper evident element 420, 440, and the frangible bridges 430 are arranged around the circumference of the second tamper evident element 440 in angular distances of 60°. FIG. 7 also very well shows the ringlike protrusion 422 of the first tamper evident element 420.

Figure 8:
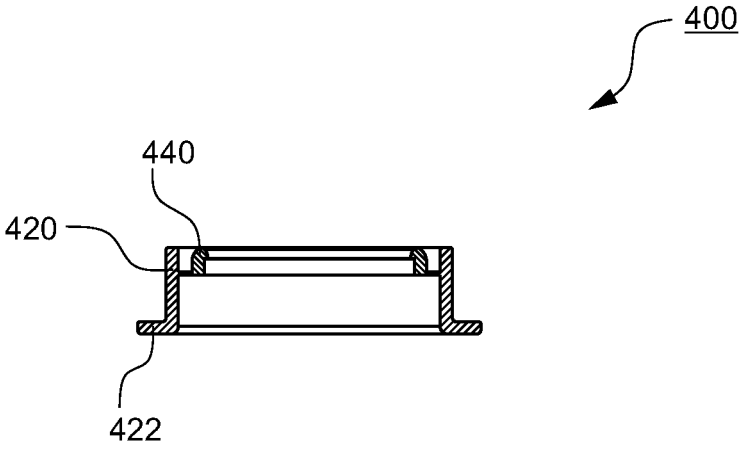
FIG. 8 shows a cross-sectional view of the tamper evident unit as shown in FIG. 7.

FIG. 8 finally shows a cross-section through the tamper evident unit 400 as shown in FIG. 7. FIG. 8 especially shows the dimensions and orientations of the first and the second tamper evident element 420 and 440 relative to each other, with the second tamper evident element 440 being fully within the space defined by the first tamper evident element 420, so that the second tamper evident element 440 is fully covered from view by the first tamper evident element 420 when viewed from the outside.

It is clear to the expert that various amendments can be made to the embodiments without departing from the scope of the present invention as defined by the attached claims, and any features disclosed in connection with the embodiments or the general description can be important for realizing the invention, either alone or in any combination thereof.

The invention claimed is:

1. Closure for a container with a base element (100), a flip-top lid (200) attached to said base element (100) by a hinge (150) such that the flip-top lid (200) can be moved between an opened and a closed position, a tamper evident unit (400) for indicating whether the flip-top lid (200) had been opened at least once by a user or not, said tamper evident unit (400) comprising a first tamper evident element (420) and a second tamper evident element (440), which are, when said closure is in its as-manufactured status or when said flip-top lid (200) has not been opened yet by the user, connected to each other by at least one frangible bridge (430), wherein said first tamper evident element (420) is retained relative to the base element (100) such that it is movable between a first position and a second position, wherein said first tamper evident element (420) is in its first position, when said closure is in its as-manufactured status or when said flip-top lid (200) has not been opened yet by the user, and said first tamper evident element (420) is in its second position, when said flip-top lid (200) had been opened at least once by the user, wherein said flip-top lid (200) is at least in part transparent or translucent and/or comprises at least one opening or window, wherein said base element (100) comprises at least one spring element (120) being arranged such that it applies a force FS onto said first tamper evident element (420) into a direction towards the second position of said first tamper evident element (420), said force FS being smaller than a minimum force FD being necessary to destroy the at least one frangible bridge (430), wherein said flip-top lid (200) comprises a first inner extension wall (220) with first engagement means (222) and wherein said second tamper evident element (440) comprises second engagement means (442), said first engagement means (222) and second engagement means (442) being arranged such that they engage with each other when said closure (10) is in its as-manufactured status, and wherein said first (222) and said second engagement means (442) are arranged such that a minimum force FE being necessary to disengage the first engagement means (222) and second engagement means (442) from each other is larger than said force FD being necessary to destroy the at least one frangible bridge (430).

2. Closure according to claim 1, wherein said first tamper evident element (420) and/or said second tamper evident element (440) are ringlike elements.

3. Closure according to claim 1, wherein said second tamper evident element (440) is smaller or has a smaller diameter than said first tamper evident element (420).

4. Closure according to claim 1, wherein said first tamper evident element (420) and said second tamper evident element (440) are concentric or essentially concentric to each other.

5. Closure according to claim 1, wherein said first tamper evident element (420) has a height being larger than the height of said second tamper evident element (440).

6. Closure according to claim 1, wherein said second tamper evident element (440) is arranged within said first tamper evident element (420) such that a height of said second tamper evident element (440) fully overlaps with a height of said first tamper evident element (420) or such that the second tamper evident element (440) cannot be seen when viewed from a radial outward direction when said at least one frangible bridge (430) is undestroyed.

7. Closure according to claim 1, wherein said first tamper evident element (420) comprises an outwardly extending protrusion (422), being arranged such that said at least one spring element (120) of said base element (100) exerts a force onto said protrusion (422) of said first tamper evident element (420) into the direction of said second position of said first tamper evident element (420).

8. Closure according to claim 1, comprising multiple frangible bridges (430) connecting said first tamper evident element (420) and said second tamper evident element (440), wherein said multiple frangible bridges (430) are arranged around an outer circumference of said second tamper evident element (440).

9. Closure according to claim 1, wherein said closure comprises a spout (300) being an element separate from said base element (100) and which is inserted through an opening (118) on an upper side (115) of said base element (100) and being attached to said base element (100) in a fixed position.

10. Closure according to claim 9, wherein said spout (300) comprises an outwardly extending protrusion (322) and wherein said base (100) comprises at least one abutment portion (122), wherein said protrusion (322) and said at least one abutment portion (122) are arranged such that they are positioned with a distance from each other, thereby providing a space therebetween in which at least part of said at least one spring element (120) and at least part of said outwardly extending protrusion (422) of said first tamper evident element (420) are positioned.

11. Closure according to claim 10, wherein said first tamper evident element (420) abuts against said spout against said outwardly extending protrusion (322) of said spout (300), when said first tamper evident element (420) is in its second position.

12. Closure according to claim 1, wherein said at least one spring element (120) is arranged such that it exerts a force FF onto said first tamper evident element (420), preferably onto said outwardly extending protrusion (422) of said first tamper evident element (420), when said first tamper evident element (420) is in its second position.

13. Closure according to claim 9, wherein said first inner extension wall (220) has an essentially cylindrical form, extending from a top part or a top wall (260) of said flip-top lid (200), wherein said spout (300) and said first inner extension wall (220) are arranged such that said spout (300) is inserted into said first inner extension wall (220) of said flip-top lid (200), when said flip-top lid (200) is in its closed position.

14. Closure according to claim 9, wherein said flip-top lid (200) comprises a second inner extension wall (240), having an essentially cylindrical form, said second inner extension wall (240) extending from a top part or top wall (260) of said flip-top lid (200), wherein said spout (300) and said second inner extension wall (240) are arranged such that said second inner extension wall (240) is inserted into a dispensing opening (320) of said spout (300), when said flip-top lid (200) is in its closed position.

15. System with a container and with a closure according to claim 1, wherein said closure is attached to the container or wherein said closure is integrally formed with the container.

16. Method for manufacturing a closure according to claim 1, wherein said base element (100) and said flip-top lid (200) are manufactured by injection molding and in an open status with said flip-top lid (200) being in its opened position.

17. Method according to claim 16, wherein a spout (300) is manufactured separately from said base element (100) and said flip-top lid (200), wherein after injection molding of said base element (100) and said flip-top lid (200) in its open status, the flip-top lid (200) is first brought into its closed position, wherein thereafter the tamper evident unit (400) and said spout (300) are inserted into said base element (100) while said flip-top lid (200) is in its closed position.

18. Method according to claim 17, wherein said tamper evident unit (400) is positioned onto said spout (300), wherein thereafter said spout (300), together with said tamper evident unit (400), is inserted into said base element (100) while said flip-top lid (200) is in its closed position.

* * * * *